US005261666A

United States Patent [19]

Chen et al.

[11] Patent Number: 5,261,666

[45] Date of Patent: Nov. 16, 1993

[54] GAME DEVICE

[76] Inventors: Pan B. S. Chen; Chung C. Chen, Both of P.O. Box 15316, Arlington, Va. 22215

[21] Appl. No.: 29,731

[22] Filed: Mar. 25, 1993

[51] Int. Cl.[5] ..... A63F 9/04; A63F 5/04

[52] U.S. Cl. ..... 273/146; 273/143 A; 273/147

[58] Field of Search ..... 273/146, 147, 143 A

[56] References Cited

U.S. PATENT DOCUMENTS

| | | | |
|---|---|---|---|
| 634,579 | 10/1899 | Long et al. | 273/143 A |
| 2,526,123 | 10/1950 | Dawson | 273/146 |
| 2,794,644 | 6/1957 | Johnson | 273/147 |
| 3,208,754 | 9/1965 | Sieve | 273/146 |
| 3,495,832 | 2/1970 | Thomassen-Behle | 273/146 |
| 3,603,593 | 9/1971 | Chew | 273/146 |
| 3,655,197 | 4/1972 | Milbaum | 273/146 |
| 4,546,978 | 10/1985 | David | 273/146 |
| 4,927,158 | 5/1990 | Lierman | 273/146 |
| 5,096,203 | 3/1992 | Elstein et al. | 273/281 |

FOREIGN PATENT DOCUMENTS

| | | | |
|---|---|---|---|
| 75700 | 8/1893 | Fed. Rep. of Germany | 273/146 |
| 801077 | 12/1950 | Fed. Rep. of Germany | 273/146 |
| 3621744 | 1/1988 | Fed. Rep. of Germany | 273/146 |
| 820991 | 11/1937 | France | 263/146 |
| 2528320 | 12/1983 | France | 273/146 |
| 2107996 | 5/1983 | United Kingdom | 273/143 A |
| 2137514 | 10/1984 | United Kingdom | 273/147 |

*Primary Examiner*—Benjamin H. Layno

[57] ABSTRACT

A game device comprising mainly a geometric body having at least two flat external faces, each of the flat external faces is provided with at least one indicating piece, each of the indicating piece is provided with at least one indicating face, each of the indicating faces is provided with at least one indicium.

9 Claims, 2 Drawing Sheets

FIG. 1
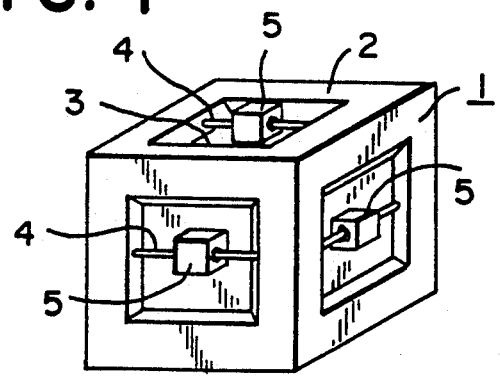
FIG. 5
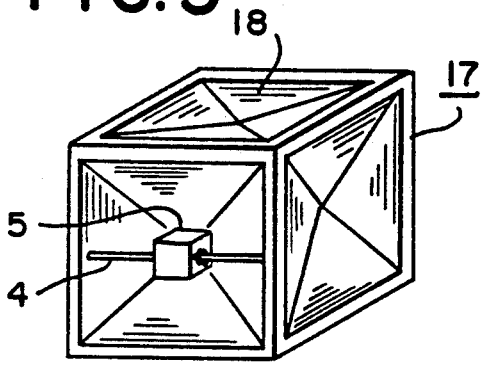
FIG. 2
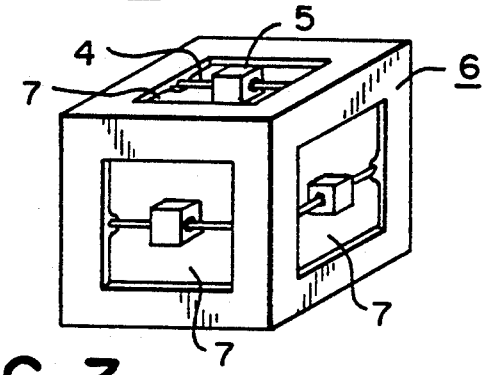
FIG. 6
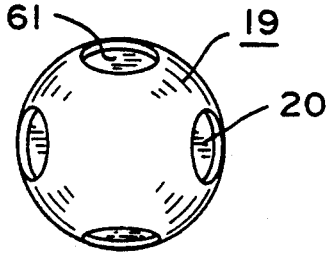
FIG. 3
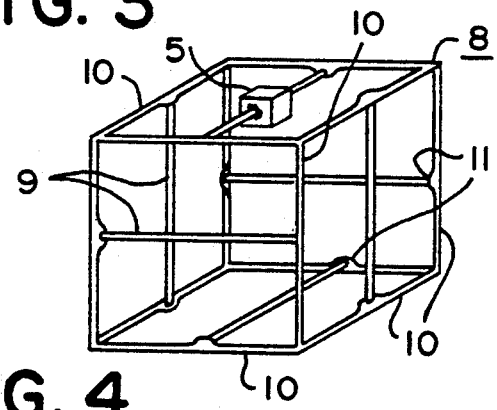
FIG. 7
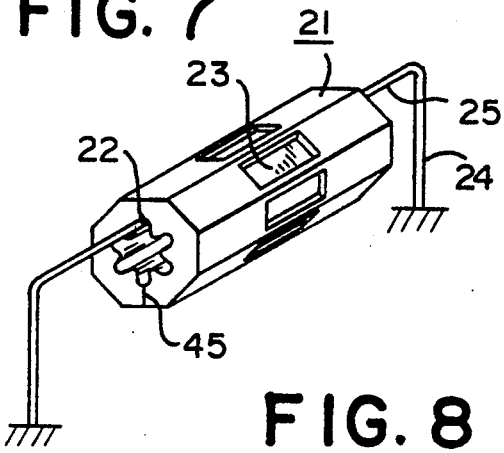
FIG. 4
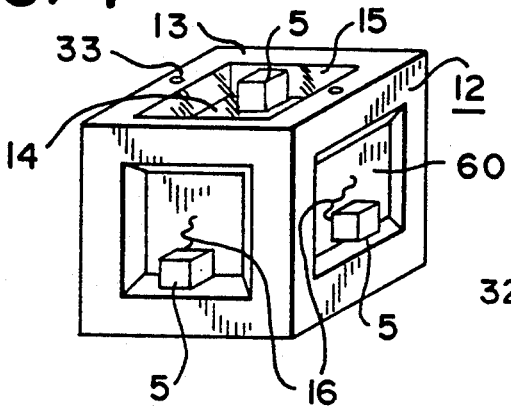
FIG. 8
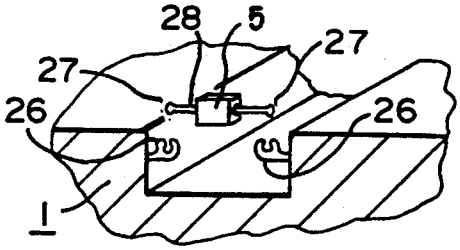
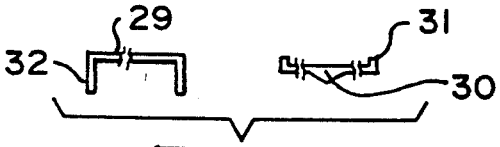
FIG. 9

GAME DEVICE

BACKGROUND OF THE INVENTION

This invention relates to a game device, particularly to a die.

In the conventional dice, each of the six faces of the dice carries an individual symbol, whereby on throwing the die, six different results of the throw are possible.

There are available various conventional game devices which do not provide the novel improvements of the invention herein disclosed.

SUMMARY OF THE INVENTION

A primary object of the present invention is to provide a die that will provide more than six different results of the throw.

The die of the present invention comprises mainly a geometric body having a plurality of flat external faces, each of the flat external faces is provided with at least one indicating piece, each of the indicating piece is provided with at least one indicating face, each of the indicating faces is provided with an indicium.

BRIEF DESCRIPTION OF THE DRAWINGS

FIG. 1 is a perspective view of the first embodiment of the present invention;

FIG. 2 is a perspective view of the second embodiment of the present invention;

FIG. 3 is a perspective view of the third embodiment of the present invention;

FIG. 4 is a perspective view of the fourth and fifth embodiments of the present invention;

FIG. 5 is a perspective view of the sixth embodiment of the present invention;

FIG. 6 is a perspective view of the seventh embodiment of the present invention;

FIG. 7 is a perspective view of the eighth embodiment of the present invention;

FIG. 8 is an enlarged perspective view showing one of the examples of attaching an indicating piece and a shaft to a face of a die of the present invention;

FIG. 9 shows the parts required to turn the die of the present invention into a top;

DETAILED DESCRIPTION OF THE INVENTION

Figure 10:
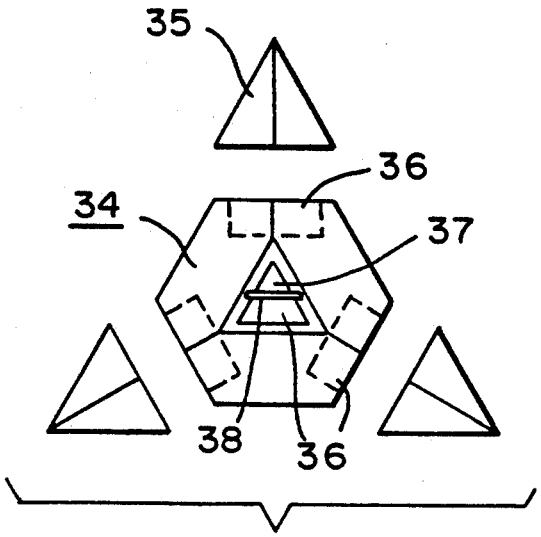
FIG. 10 shows a top view of a ninth embodiment of the present invention.

Referring to FIG. 1, a die 1 is a first embodiment of the present invention. The die 1 is a cube having a recess 3 on each of the faces. A shaft 4 is attached to each of the faces. At least an indicating piece 5 is rotatably supported on the shaft 4. An upturned face (a face that faces upward) 2 is an indicating side of the die 1 at this position. The indicating piece 5 has at least one indicating face. Each of the indicating faces has an indicium (not shown in the drawings). An upturned face of the indicating piece 5 is an indicating face of the die 1. As shown in the drawing, each of the indicating pieces 5 has four indicating faces and the die has six faces. Therefore, there are at most twenty-four different results of the throw. The indicia on the indicating faces could be numbers (e.g., 1,. . . , 6,. . . , 9,. . . ), marks, tokens, symbols, spots (dots), letters, pictures, words, figures, signs, the indicia of playing cards, the combination thereof, or the like. Each of the indicia can be printed, or engraved on the indicating pieces, formed integrally with the pieces, or printed on a piece of adhesive paper and attached to the indicating pieces by the manufacturer, or the consumer. All of the indicia are not shown in the drawings for the sake of clarity.

Figure 11:
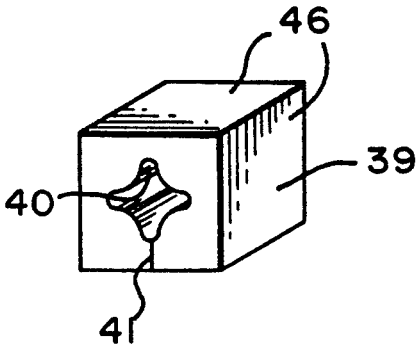
FIGS. 11–13 each shows an enlarged perspective view of an example of the indicating piece used in the present invention.
Figure 12:
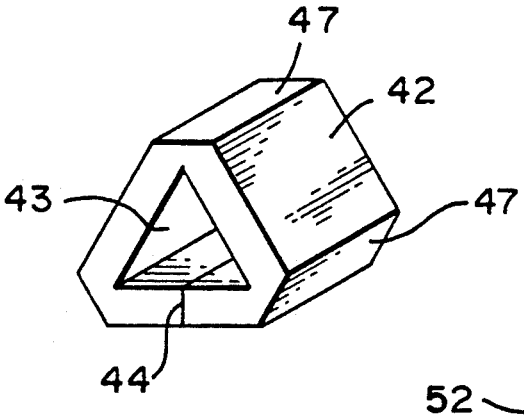
Figure 13:
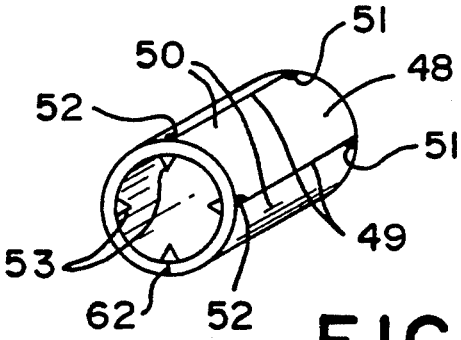

Some examples of the enlarged view of the indicating pieces are shown in FIGS. 11–13. Indicating piece 39 (FIG. 11) has four indicating faces 46 (it could also have five or more indicating faces) and a central groove having depressions 40 and a split (cut) portion 41 The split (cut) portion 41 is optional. The purpose of the split (cut) portion is to facilitate the insertion of a shaft 4 to the central groove of the indicating piece 39 if the shaft 4 could not be inserted into the central groove longitudinally. The purposes of the split (cut) portions 45, 44, 62 shown in FIGS. 7, 12, 13 respectively are the same as this.

Indicating piece 42 (FIG. 12) has three indicating faces 47 and a central groove 43.

Figure 14:
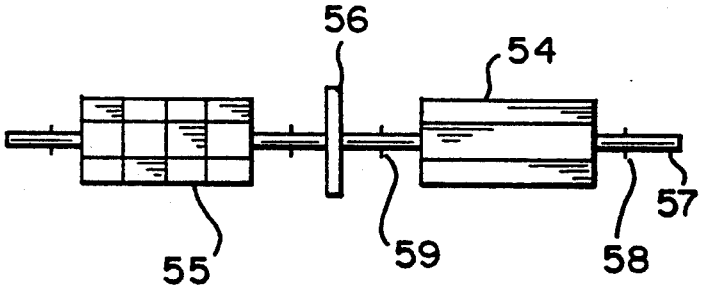
FIG. 14 shows an example of two indicating pieces and a shaft having a divider and some marks thereon.

Indicating piece 48 (FIG. 13) is of a shape of a hollow right circular cylinder and has four indicating faces 50 separated with borderlines 49, four inward projections 53 (optional), four right side marks 51, and four left side marks 52. The purpose of the marks 51 and 52 is that, when a shaft happens to be aligned with one of the borderlines 49, the indicating face having a mark 51 will prevail if the indicating piece 48 is closer to the right end of the shaft, the indicating face having a mark 52 will prevail if the indicating piece 48 is closer to the left end of the shaft. Another throw is required if it happens that the shaft is aligned with one of the borderlines and the indicating piece is exactly at the middle of the shaft. In FIG. 14, a shaft 57 is divided into two sections with a divider 56 and has two indicating pieces 54 and 55 thereon. Indicating marks 58 and 59 help the user determine whether the indicating pieces 54, 55 are closer to the right end or left end of a section of the shaft 57, respectively.

In the example shown in FIG. 14, the indicating pieces 54 and 55 each has four indicating faces, the indicating piece 55 is further divided vertically into four sections. Different colors or letters (e.g., yellow, red, blue, green; or A, B, C, D) can be provided on each of the indicating faces of the indicating piece 54 and each of the vertically divided sections of the indicating piece 55. In this way, these two pieces 54 and 55 can provide sixteen different results which can be marked on the sixteen small sections on the piece 55. That is to say, there will be at most ninety-six different results if the subassembly shown in FIG. 14 is used on each of the faces of the die shown in FIG. 1.

The number of the indicating pieces on a shaft could be more than two. For example, the first piece has A, B, C, D marked on each of the faces respectively, the second piece has E, F, G, H marked on each of the faces respectively, the third piece is divided into sixteen vertical sections each marked with AE, AF, AG, AH, BE,..., DH respectively. Then, there will be 64 different results. The pieces also can be provided on three different shafts which can be supported in each face of a die.

The dice, the indicating pieces, and the shafts etc. shown in the drawings are for the purpose of illustration only and not necessarily to the scale. Also, many of the shafts and indicating pieces are not shown in the drawings for the sake of clarity. Each of the parts can be made of wood, metal, elastomeric, foamed or rigid plastic or the like. Each of the dice can be of various geometric shapes (e.g., hollow or solid sphere or ball (FIG. 6), polygons, polyhedrons, a geometric body formed of frames as shown in FIG. 3, or a geometric body formed of walls as shown in FIG. 5). The corners of the dice can be chamfered or made smooth. The shapes of the dice shown in FIGS. 1-5 are cubes. It can also be any other suitable shapes, e.g., icosahedron, tetrahedron (FIG. 10), Octahedron, dodecahedron (each face can be of rhombic or pentagonal shape), hexagonal prism (FIG. 7), or the like. If an indicating piece similar to that shown in FIG. 11 having a cross-section of a pentagon instead of a square as shown in FIG. 11 is used in combination with a die of a shape of an icosahedron, there will be at most exactly one hundred different result of the throw.

In FIG. 1, the shaft can be attached to the die 1 using the means shown in FIG. 8, adhesive, a screw, a bolt, a magnet, integral-forming, a button, welding, other snap-type means, or the like.

In FIG. 8, the die 1 is provided with a pair of "socket" (or female or male engaging means) 27 on one face thereof, a shaft 28 is provided at its ends a pair of "plug" 26 (or male or female engaging means), and an indicating piece 5 is rotatably supported on the shaft 28. On the contrary, the socket could be provided on the ends of the shaft and the plug provided on the face of the die. The shaft can be prevented from inadvertently falling off the die while the shafts and the indicating pieces can be interchangeable respectively, and can be replaced.

A second embodiment of the die of the present invention is shown in FIG. 2, in which a die 6 is of a hollow cube having a cutoff portion 7 on each of the faces thereof. A shaft 4 is provided on each of the faces at the cutoff portion 7 for rotatably supporting an indicating piece 5.

A third embodiment of the die of the present invention is shown in FIG. 3, in which a die 8 comprises mainly a plurality of rods 10 which each has an inward-bent portion 11 for attaching a shaft 9. The shaft 9 rotatably supports an indicating piece 5. The reasons for the rods 10 to have an inward-bent portion 11 is that the shaft 9 and the indicating piece 5 can be kept inside of the corresponding face of the die so that, when the die comes to rest after a throw, the indicating piece 5 at the downturned face (the face facing downward) can be prevented from protruding outward of the downturned face and thus the die 8 can be prevented from being oblique when it comes to rest after the throw. For the same reason, the shafts and the indicating pieces used in FIGS. 1, 2, 5, 6, 7, and 10 are kept inside of the corresponding face of the die when the die comes to rest after a throw. In FIG. 2, the face portion close to the cutoff portion 7 can be bent inwardly to achieve this effect, or inward tabs can be provided for attaching the shafts utilizing socket shown in FIG. 8, or other means.

FIG. 4 shows a fourth and fifth embodiments of the present invention in which a die 12 has a recess 14 or 60 formed on each of the faces thereof. In the upturned face 13, (fourth embodiment), a transparent cover 15 is provided for covering this face and an indicating piece 5 can be prevented from falling off the die while being able to roll freely in the face. On the side face, a string 16 is attached at one end in the recess 60 (fifth embodiment). The other end of the string 16 attaches an indicating piece 5. The length of the string 16 is limited so that the indicating piece 5 can roll freely while preventing the die 12 from being oblique after a throw.

FIG. 5 shows a sixth embodiment of the present invention, in which a die 17 is formed of mainly "oblique" walls of a cube, each of the faces of the die 17 has a recess 18 for positioning a shaft which in turn rotatably supports an indicating piece 5.

FIG. 6 shows a seventh embodiment of the present invention, in which a die 19 is of generally solid ball (spherical) shape having a plurality of cutoff flat faces 20. Each of the faces 20 has a recess 61 for positioning a shaft and an indicating piece (not shown in the drawing).

The die 19 can be formed of a hollow ball. In this case, and the embodiment shown in FIG. 2, the arrangement shown in FIG. 4 can also be used, i.e., side walls and bottom walls can be formed at each of the cutoff portions and a cover or a string and an indicating piece can be provided, so that the appearance of the die 6 can be similar to that of the die 12 (FIG. 4).

FIG. 7 shows an eighth embodiment of the present invention, in which a die 21 is of the shape of hexagonal prism which has a central longitudinal groove having depressions 22. The die 21 has a recess 23 on each of the faces, a horizontal shaft 25, and a support 24. The support 24 can be fixed to a table, a floor, or a base not shown in the drawing. A shaft and an indicating piece can be supported on each of the recesses 23.

FIG. 9 shows a whirl head 29 having rod portions 32 and a pointed portion 30 having rod portions 31. The rod portions 32 can be inserted into holes 33 shown in FIG. 4, the rod portions 31 can be inserted into holes (not shown in the drawing) on the downturned face (the face facing downward). This turns the die 12 into a top which can be spinned.

Sometimes, a die will have an apex (top corner), instead of a flat face, facing upward. For example, if we use a tetrahedron as a die, an apex faces upward after a throw. In this case, the tetrahedron can be truncated to form a die 34 (FIG. 10), which is the ninth embodiment of the present invention. On each of the truncated portions, a recess 36 is formed for supporting a shaft 38 and an indicating piece. Since FIG. 10 is a top view of the die 34, a top face 37 can be seen thereon. Four transparent hollow covers 35 can be attached to the die 34.

The shape of the indicating piece shown in FIG. 13 can also be used as a die for the embodiment shown in FIG. 7. In this case, the indicating piece and the shaft 25 can be provided with marks 51, 52, 58, 59 similar to that shown in FIGS. 13 and 14, and each indicating face 50 can be provided with a cutoff portion for supporting an indicating piece and a shaft.

The shape of the indicating piece shown in FIG. 13 can also be solid, having a central longitudinal groove and a plurality of depressions similar to those shown in FIG. 11. If this is used for the die shown in FIG. 7, it can be provided with a recess on each indicating face. The recess can support a shaft and an indicating piece.

When a die is to be played (thrown), it can be put into a dice cup or other agitating means, shaked, and then thrown out on a flat face or thrown with a hand to a flat face. At this time, each of the indicating pieces rotates about a corresponding shaft (FIGS. 1, 2, 3, 5, 6, 7 and 10), or in the recess (FIG. 4), till it stops rolling (i.e., comes to rest) An indicium on an upturned face of an indicating piece on an upturned face of the die shows the result of the throw.

Various changes can be made without departing from the scope of the claims of the present invention. For example, a convex lens or two convex lenses can be provided on the cover 15 or 35 (Figs. 4, 10) as a magnifier; an illumination means can be provided in the die; a motor or other motive means and a transmission means can be used for moving the shafts, the indicating pieces, and/or the die; a spring or an elastic means can be provided on the corners of the dice to enhance the playing effect; each of the main bodies of the dice can be formed integrally or formed of two or more pieces and assembled together; and each of the shafts can be supported on a bearing subassembly on the dice so that the shaft can rotate freely thereon.

The dice of the present invention can be used for e.g. bingo, selection of lotto numbers, I-Ching (a Chinese fortune telling means), playing cards, and other games. The dice can also serve as a decoration and inspire three-dimensional way of thinking.

We claim:

1. A die comprising:

a geometric body having a plurality of flat external faces, at least one shaft attached to each of the flat external faces, and at least one indicating piece rotatably supported on each of the shafts, wherein each of indicating pieces has at least one indicating face having at least one; indicium on each of the indicating faces.

2. The die according to claim 1, wherein each of the flat external faces is provided with a recess for attaching the shaft.

3. The die according to claim 1, wherein the geometric body is a hollow body, the flat external faces have cutoff portions thereon, the shafts are attached beside the cutoff portions.

4. The die according to claim 3, wherein an inward tab is provided on each part of the hollow body which is close to a part of the cutoff portion for attaching a shaft.

5. The die according to claim 3, wherein each part of the hollow body which is close to a part of the cutoff portion for attaching a shaft is bent inwardly.

6. The die according to claim 1, wherein at least one mark can be formed on the shaft.

7. The die according to claim 1, wherein the indicating piece is a hollow cylinder divided by at least one borderline, at least one mark can be formed close to the borderline of the indicating pieces.

8. The die according to claim 1, wherein the geometric body is constructed of a plurality of rods so that the geometric body is in the shape of a hollow geometric frame.

9. A die comprising:

a geometric body having a plurality of flat external faces and, at least one indicating piece provided on each of the flat external faces, wherein each of the indicating pieces has at least one indicating face having at least one indicium on each of the indicating faces and;

wherein a recess is formed on each of the flat external faces, a string is employed for attaching the indicating piece to the recess so that the indicating piece can roll freely while being prevented from falling off the die.

* * * * *